US006691597B2

(12) United States Patent
Granger

(10) Patent No.: US 6,691,597 B2
(45) Date of Patent: Feb. 17, 2004

(54) DISPENSING MACHINE FOR WIPE MATERIAL

(76) Inventor: Maurice Granger, 17 Rue Marcel Pagnol, Saint Priest En Jarez 42270 (FR)

( * ) Notice: Subject to any disclaimer, the term of this patent is extended or adjusted under 35 U.S.C. 154(b) by 0 days.

(21) Appl. No.: 10/103,013

(22) Filed: Mar. 21, 2002

(65) Prior Publication Data

US 2002/0117034 A1 Aug. 29, 2002

Related U.S. Application Data

(63) Continuation of application No. PCT/FR00/02887, filed on Oct. 17, 2000.

(30) Foreign Application Priority Data

Oct. 26, 1999 (FR) ..... 99 13691
Feb. 29, 2000 (FR) ..... 00 02722

(51) Int. Cl.[7] ..... A47K 10/36; B65H 35/00

(52) U.S. Cl. ..... 83/335; 83/337; 83/649; 83/949

(58) Field of Search ..... 83/298, 334, 335, 83/337, 338, 649, 937, 949; 242/547, 564.5

(56) References Cited

U.S. PATENT DOCUMENTS 4,122,738 A 10/1978 Granger ..... 83/314
4,203,562 A * 5/1980 DeLuca et al. ..... 242/560.1
4,213,363 A 7/1980 Granger ..... 83/298
4,432,261 A * 2/1984 DeLuca ..... 83/334
4,441,392 A * 4/1984 DeLuca ..... 83/337
5,836,862 A * 11/1998 Granger ..... 493/459
5,868,343 A 2/1999 Granger ..... 242/564.4
6,112,631 A * 9/2000 VanAlstine ..... 83/649
6,196,102 B1 3/2001 Granger ..... 83/335

FOREIGN PATENT DOCUMENTS

FR 2 332 215 A 6/1997
FR 2 742 737 A 6/1997
FR 2 771 620 A 6/1999
FR 2 778 077 A 11/1999
FR 2 799 946 A 4/2001
WO WO 97 24970 A 7/1997
WO WO 98/03108 * 1/1998
WO WO 99/27833 * 6/1999

* cited by examiner

*Primary Examiner*—Stephen Choi
(74) *Attorney, Agent, or Firm*—Heslin Rothenberg Farley & Mesiti P.C.

(57) ABSTRACT

A dispensing machine includes a housing, a cover, a drum, a cutting blade built into the drum, and a cam and a start and return spring for starting and returning the drum. Lateral end shields of the housing support the reel of material. A pressing roller pushes against the strip of material at a specific point and a second pressure area where the strip of material is cut at the level of the drum. The pressure roller is articulated and pivoted by two swivelling levers so that it presses against the reel of material, thereby defining a distance between the tensioning areas defined by reel/pressure roller contact and drum/cutting blade ejection of about 25 to 50 cm. The two levers are not joined together and pivot independently so that the pressure roller swivels with variations of each of said levers to match the profile of the reel of material.

23 Claims, 7 Drawing Sheets

B
2
A
y
y
1b2
1b1
24
8
A1
1b3
x
16
1b
9
9a
A2
20
x
18
1b4
4
19
13b
9b
11
13
22
13'a
z
z
3b
6
6a
17
1a
3
C1
1
1c
RS

DISPENSING MACHINE FOR WIPE MATERIAL

CROSS REFERENCE TO RELATED APPLICATIONS

This application is a continuation of copending PCT application PCT/FR00/02887, filed Oct. 17, 2000, designating the United States and claiming priority from French application FR 99.13691, filed Oct. 26, 1999, and French application FR 00.02722, filed Feb. 29, 2000. The priorities of each of these applications are claimed herein, and the entire disclosures of each of these applications are incorporated herein by reference. PCT Application, PCT/FR00/02887, was published as WO 01/30226 A1 on May 3, 2001, in French.

The invention relates to the technical field of dispensing machines for paper wipes of the tissue paper type for hand wipe and toilet paper applications and wiping and cleaning in general.

The Applicant has already developed numerous machines of this type for the above-mentioned applications. These machines are of the type comprising a housing (1) with a protective cover (2), said housing being designed to internally accommodate a drum (3) devised in order to position and operate a cutting device (4). A pressure component pushes against the drum whilst reel (B) of wound material is mounted on a reel holder making it possible to dispense the strip of material to the drum with a view to cutting it after it has been manually pulled by the user through the outlet of the housing. Alternatively, the reel may rest directly against the drum.

A machine of this type is described in French Patent 2332215 and also in French Patent 2713075, including the pressure roller.

Patent FR2771620 in the name of the Applicant discloses a paper-wipe strip dispensing machine which comprises a reel of strip of paper, a pressure roller which comes into contact with the strip on the reel and a drum with a blade which cuts the strip. The pressure roller is articulated and pivoted by two swivelling levers so that it is in permanent contact and pushed against reel, thereby defining a clearance of the order of 25 to 50 cm between the tensioning areas defined by reel/pressure roller contact on the one hand and drum/cutting blade ejection on the other hand.

One of the problems which have been encountered is that of tensioning the material between the areas defined by the point where the pressure roller touches the drum and the upper part of the reel of material.

The ejection of cutting blade **(4*a*)** close to the support point of the pressure roller and the drum (roughly 2 to 4 centimeters) encourages the formation of folds in the strip of material due to lack of tension between above-mentioned support and penetration of the blade into the material, so that the material is not always clean cut. This drawback is currently encountered in both cases, i.e. when the dispensing machine comprises a reel of material pressing directly against the drum or when the dispensing machine comprises a suspended reel of material which does not touch the drum, this contact being ensured by the pressure roller pushing against the drum which accommodates the cutting device.

Another drawback of dispensing machines of prior art as described must also be emphasised. Dispensing the strip of material is braked due to the pressure roller pushing directly against the drum, especially when the blade moves into the hollow blade ejection receptacle and also in the case of a deformed drum which allows format adjustment.

The object sought after according to the invention was to devise a new dispensing machine for wipe material which overcomes these drawbacks.

The solution found involves completely rethinking the dispensing machine in order to solve the problems stated above.

According to a first aspect, the dispensing machine for wipe material is of the type comprising a housing, a cover, a drum, a cutting blade built into the drum, means of starting and returning the drum including a cam and a start and return spring both located on one side of the drum, the lateral end shields of the housing being devised to support the reel of material, a pressure roller being capable of pushing against the strip of material at a specific point in addition to a second pressure area towards the area where the strip of material is cut at the level of the drum, the pressure roller being mounted so that it is articulated and pivoted by two swivelling levers so that it comes into permanent contact and presses against the reel of material, thereby defining a distance between the tensioning areas defined by reel/pressure-roller contact on the one hand and drum/cutting blade ejection on the other hand of the order of 25 to 50 cm, characterised in that the two levers (9–10) are not joined together and pivot independently so that the pressure roller (8) can swivel with variations of each of said levers making it possible to match the profile of the reel of material.

These aspects and others will become apparent from the following description.

The object of the present invention is described, merely by way of example, in the accompanying drawings in which.

Figure 1:
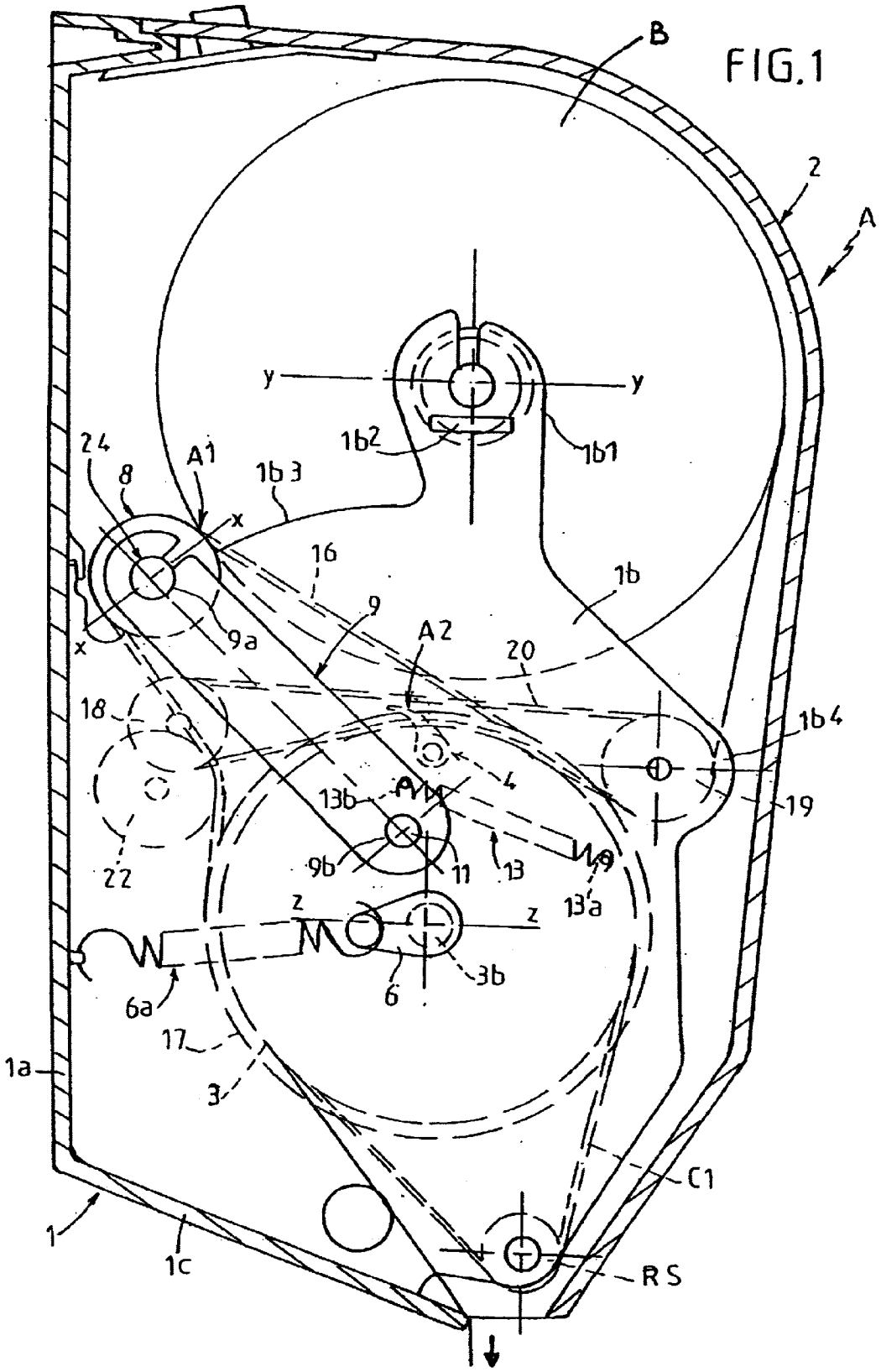
FIG. 1 is a left-hand side-face view of the dispensing machine according to the invention with its cover removed, from the same side as the device for starting the drum.
Figure 2:
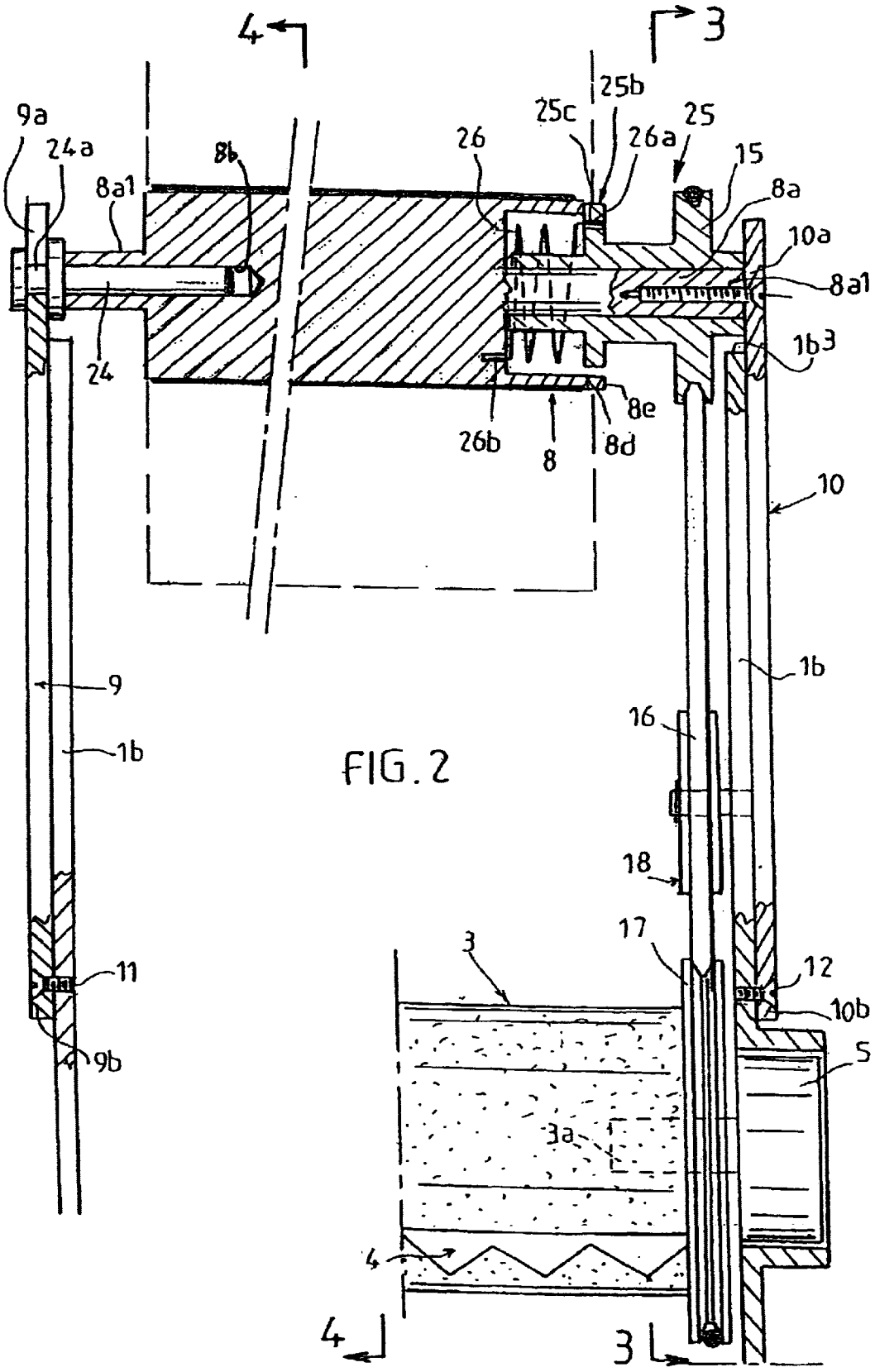
FIG. 2 is a partial cutaway view showing the link between the drum and the pressure roller.
Figure 3:
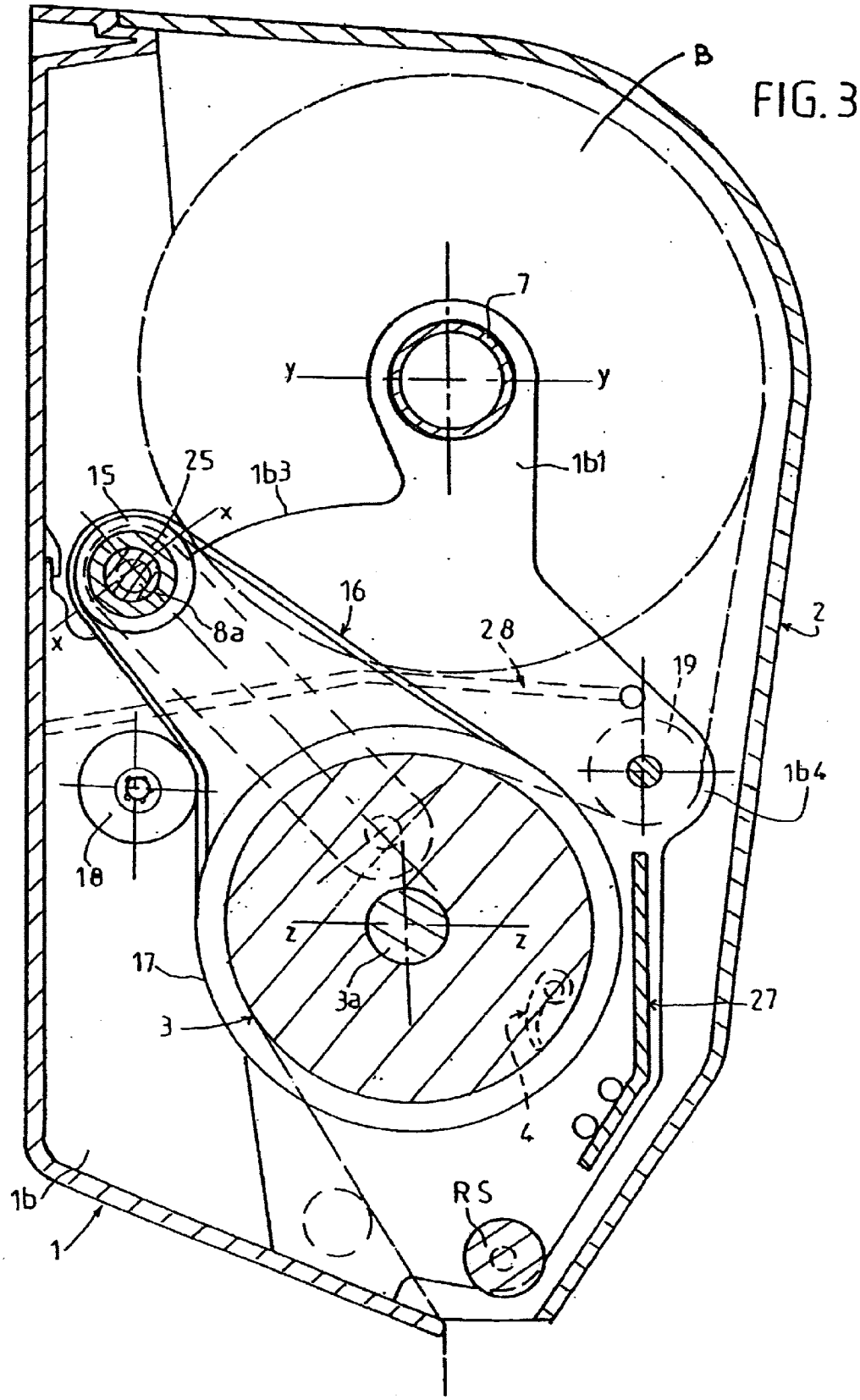
FIG. 3 is a side-face view of the dispensing machine according to the invention along line 3—3 in FIG. 2 showing the path of the connecting belt between the pressure roller and the drum.
Figure 4:
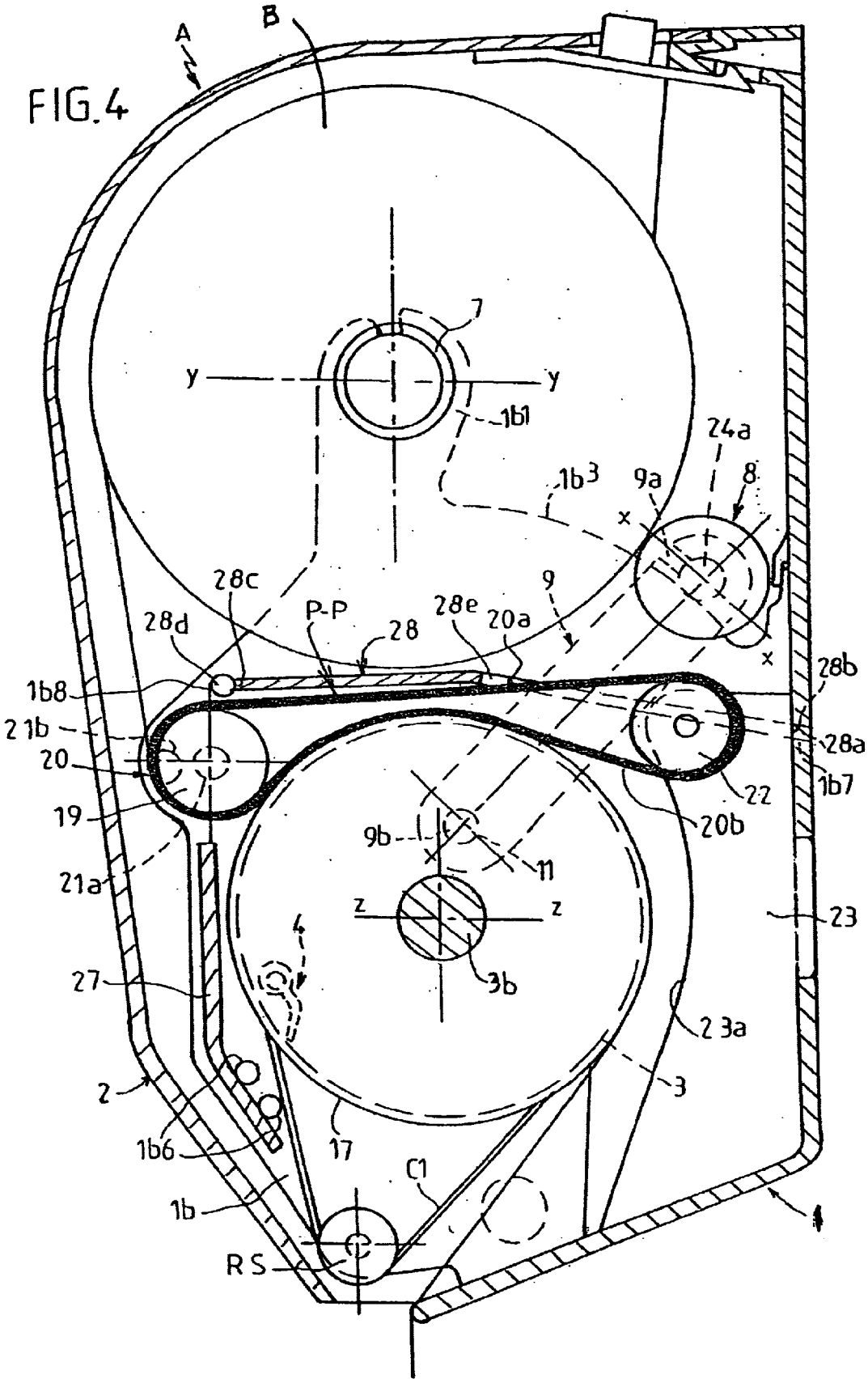
FIG. 4 is a cutaway side-face view along line 4—4 in FIG. 2 showing, in particular, the third guide belt for the strip of material and the first connecting belt between the drum and the safety roller.
Figure 5:
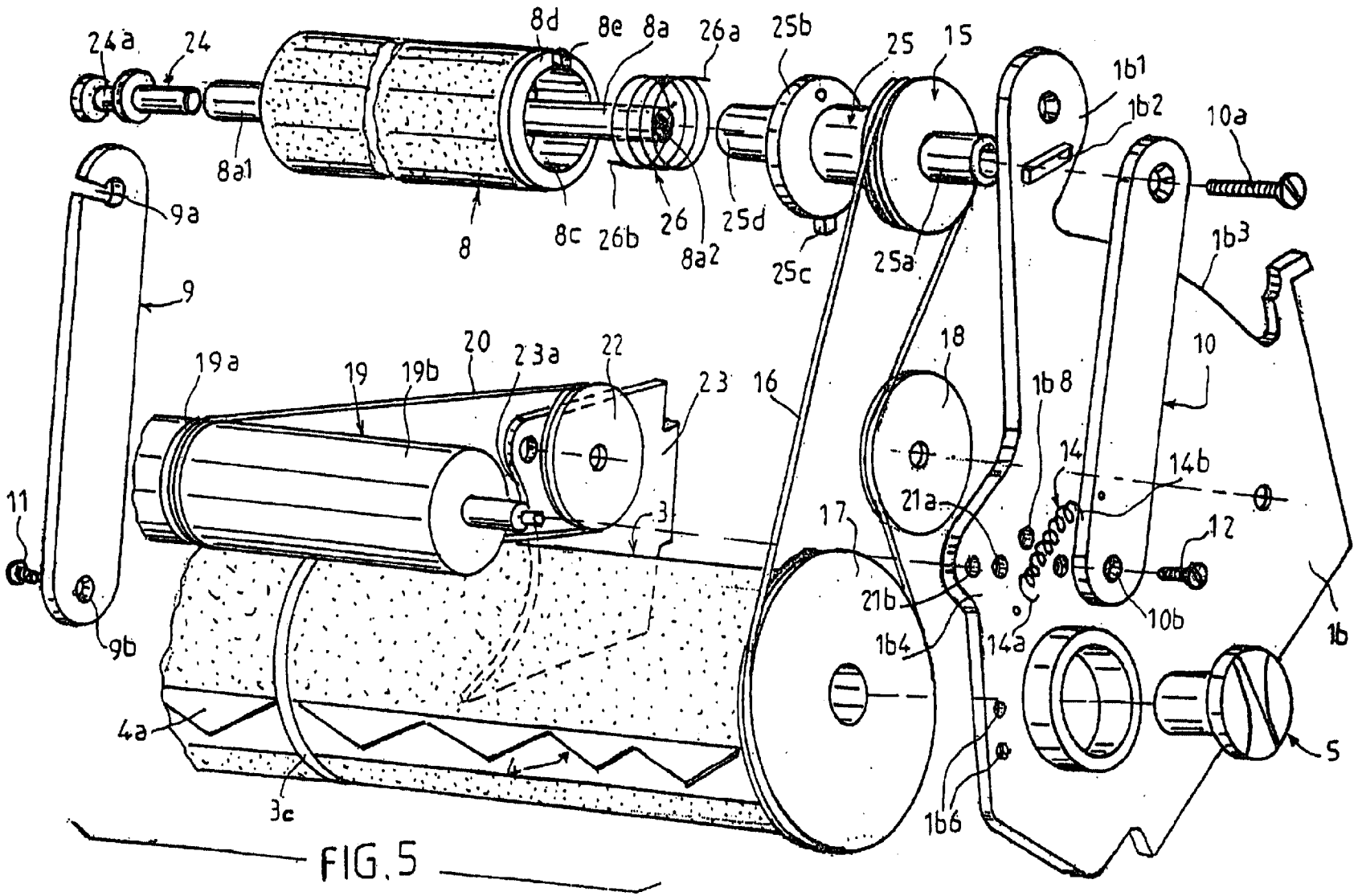
FIG. 5 is a partial exploded view before assembly showing some of the mechanisms of the invention, in particular the pressure roller, the return idler and the linkage of the mechanisms.

In order that the present invention may more readily be understood, the following description is given, merely by way of example, reference being made to the accompanying drawings.

The dispensing machine referred to in its entirety as (A) comprises, in a known manner, a wall-mounted housing (1) having a back wall **(1*a*), two lateral end shields (1*b*), a slanting base (1*c*) and a cover (2). The lateral end shields accommodate the freely rotating shafts (3*a*–3*b*) of a drum (3) including a cutting blade (4*a*)** of the cutting device appropriately designed with a rack gear assembly (not shown) which can be retracted inside the drum when it is idle and ejected from the drum with a view to cutting the material which is pulled out of the machine manually as disclosed in French Patents No. 2332215 and 2779050.

The shaft (3*a*) on one side of the drum cooperates with an operating knob (5) which is accessible on one side with a view to loading whereas the other shaft (3*b*) cooperates with an eccentric lever (6) for starting the drum which is connected by a spring (6*a*) associated with end shield (1*b*).

Note that, underneath drum (3), a freely rotating safety roller (RS) is fitted in connected by belt (C1) to a central groove (3*c*) on drum (3), said safety roller preventing fingers being poked into the machine at the level of the cutting blade (4*a*) but leaving the outlet for the material unobstructed.

The dispensing machine according to the invention is designed as follows: the lateral end shields (1*b*) between which the drum is fitted extend towards the top of the machine in order to accommodate two end pieces rotatably mounted on supports physically joined to the upper part (1*b*1) of above-mentioned end shields. These end pieces fit inside the spindle of the reel of material. The two lateral end shields (1*b*) can be spread apart elastically in order to allow insertion of the reel of material (B). To achieve this, each end shield (1*b*) has an external gripping flat (1*b*2) enabling the operator to spread them apart substantially in order to load and install the reel of material. It should be noted that said grip surfaces are in contact with the inside walls of the cover when the latter is fitted so that the cover pushes against and tightens up the end shields (1*b*) in order to secure the mechanisms and components of the machine more effectively.

Underneath the positioning of the reel of material (B) there is, according to a first aspect of the invention, a pressure roller (8) which is mounted so that it is articulated and pivots backwards and is permanently in contact and pushes against the reel of material (B). To achieve this, the rear edge of the end shields (1*b*) are designed with a curved shape (1*b*3) forming a guide ramp, thus enabling backward displacement of said pressure roller (8). To achieve this, said pressure roller (8) comprises a longitudinal shaft (8*a*), the ends (8*a*1–8*a*2) of which rest against the respective curved edge (1*b*3) of the end shields (1*b*) protruding substantially from the latter so that they can engage in hook shaped parts (9*a*–10*a*) on two swivelling levers (9–10) located either side of each of above-mentioned end shields (1*b*), outside the space which accommodates the drum, the pressure roller and the load reel. The two levers (9–10) are articulated respectively at their base (9*b*–10*b*) on a pivot pin (11–12) located in the lower part of the end shields (1*b*). Each lever (9–10) is associated with a return spring (13–14), one end (13*a*–14*a*) of which has a fixed position on above-mentioned end shields (1*b*) and the other end (13*b*–14*b*) of which is on lever (9–10).

In one embodiment of the invention, the two levers (9–10) are not connected to each other so that pressure roller (8) can pivot with differentiated swivelling of the two levers. In this case, the pressure roller may have a longitudinal axis (x—x) which is not parallel to the longitudinal axis (y—y) of the reel (B) or the longitudinal axis (z—z) of drum (3) underneath. This differentiation, advantageously, makes it possible to match any shape imperfections of the reel of wound material, thereby allowing the pressure roller to exert constant pressure on the reel of material regardless of any deformation of the reel.

The maximum deflection of pressure roller (8) depending on the diameter of the reel of wipe material may move it towards the back wall (1*a*) of the machine, thereby giving it an angular deflection of the order of 70 to 90°.

According to an important feature, one of the ends (8*a*) of the shaft of pressure roller (8) comprises a first return pulley (15) located on the inside of the machine relative to the end shield (1*b*) facing it. This first pulley is capable of accommodating and guiding a second belt (16) which is also guided over a second pulley (17) mounted so that it protrudes from the shaft of drum (3). This second pulley (17) is therefore located on the axial extension of the first pulley (15) of pressure roller (8). A third return pulley (18) is located at the rear of the machine in the same plane as the two previous pulleys (16–17). This third pulley (18) is rotatably mounted in the rear part of the end shield facing it, the reel support, the drum and the pressure roller.

The function of this third pulley (18) is to maintain even tension on this second guide belt (16) when the pressure roller is moved towards the rear due to the diameter of the reel, thereby preventing any breakage of the belt.

In another embodiment of the invention, the two levers (9–10) are connected. The maximum deflection of pressure roller (8) remains the same as that described in the first embodiment. The same applies to the arrangement of the pressure roller relative to the various above-mentioned pulleys.

According to the invention and thanks to these particular changes, the pressure roller (8) is substantially moved away from drum (3) and therefore the area where the strip of material comes into contact with the drum at the point of cutting by the cutting device. The gap thus obtained varies depending on the diameter of the reel of material. The gap is of the order of 25 to 50 cm depending on the diameter of said reel of material. The strip of material which is therefore tensioned between the various contact points (A1–A2) defined firstly by reel/pressure component contact (A1) and secondly drum/cutting blade ejection contact (A2), is much bigger than before and it is apparent that there is no folded area in the material of the kind encountered before. Said tension gap thus obtained exceeds one revolution of the reel when the latter is full.

Also, a return idler (19) is rotatably mounted at the front of the machine between the forwards ends (1*b*4) of end shields (1*b*). This idler roller does not touch drum (3) and is simply used to guide and return the strip of material towards the drum and cutting device. Said idler roller (19) has a central groove (19*a*) leaving room for a third transmission belt (20) which will be described later. Either side of this central groove (19*a*) there are smooth support areas (19*b*) for the strip of material. The position of this idler roller (19) between end shields (1*b*) of the housing can be varied in two areas (21*a*–21*b*) or more by openings made in said end shields (1*b*) making it possible to move this idler roller away from or closer to drum (3) depending on, for instance, the diameter of said drum.

According to an important additional feature, a fourth pulley (22) is fitted at the back of the housing and is secured by a support (23) joined to the back (1*a*) of the housing. This fourth pulley (22) is located on an axial extension (P—P) firstly of the central slit (3*a*) groove (3*c*) in the drum and secondly the groove (19*a*) on the idler roller (19). The third transmission belt (20) which links the idler roller (19) to the fourth pulley (22) in question causes it to move over the drum (3). The upper side (20*a*) of belt (20) is located above the drum and does not touch the latter. The lower side (20*b*) of belt (20) is forced to partially penetrate into central groove (3*c*) on drum (3) over an angle of between 100 and 130° inclusive depending on the diameter of pulley (22).

The strip of material from reel (B) is thus guided towards the front of the machine by idler roller (19) and goes through the gap between said idler roller (19) and drum (3), the strip of material then passes underneath the lower side (20*b*) of the third transmission belt and is pressed against drum (3). The lower side (20*b*) of said third belt therefore presses against the central groove (3*c*) of the drum and is in contact with the belt underneath, the so-called first belt (C1) which links drum (3) to the lower safety roller (RS) located close to the slit through which the material emerges from the machine.

In other words, the strip of material which is in contact with the drum so that it can be cut into pieces by the cutting device is securely held due to the function fulfilled by the lower side (20*b*) of the third belt (20). The support (23) of fourth pulley (22) has a curved edge (23*a*) facing the drum so that it is concentric with the periphery of the drum, thus accompanying the strip of material towards the outlet of the machine.

Through the design of the various mechanisms in the invention, the gap for tensioning the pulled strip of material between the first pulley contact point (A1) resulting from the pressure roller pushing against the reel of material and the second contact point (A2) resulting from ejection of the cutting blade from the drum represents a distance in excess of 25 cm and up to 50 cm when the reel is full, i.e. under conditions which are far better than those of the prior art.

According to an important additional feature of the invention, pressure roller (8) is designed with an additional special-purpose internal tensioning mechanism. The pressure roller is designed with a bearing surface (8*b*) at one end having a smaller diameter to allow it to fit in a telescopic shaft (24), one end of which (24*a*) fits in the cut out of swivelling lever (9). Moving end shields (1*b*) apart makes it possible to disengage the pressure roller from the telescopic shaft. The other end of the pressure roller has an internal cylindrical cavity (8*c*) allowing partial engagement of an end piece (25). This end piece has one end (25*a*) which cooperates with and attaches to on the corresponding swivelling lever (10). The first pulley (15) is located on this end piece on the inside so that the second transmission belt can be accommodated as stated above.

One end of said end piece (25) has a collar (25*b*) designed with a protruding element (25*c*) forming a limit stop. Said collar (25*b*), through this limit stop, moves opposite the transverse face (8*d*) of pressure roller (8) which is also designed with a protruding shape (8*e*) acting as a limit stop. Said end piece (25) extends into the recess (8*c*) of the pressure roller as a cylindrical bearing surface (25*d*) capable of pressing and coming into slight contact with the bottom of said recess. A return spring (26) is located on the cylindrical bearing surface (8*d*) with its first end (26*a*) joined to the outer collar (25*b*) and its second end (26*b*) connected in the bottom of the recess.

When the pressure roller is in contact with the reel it is subjected to normal rotation when the strip of material is pulled by the user. The tensioning mechanism inside the pressure roller is activated in two situations:

at the time of cutting when the cutting blade emerges from the drum because the strip of material is pulled and stretched between the two contact points: firstly reel/pressure roller and secondly drum/cutting blade ejection. Ejecting the blade therefore increases the diameter of the drum when the blade moves. The return means of the pressure roller corrects and compensates for this force, allowing one special additional evolution of the pressure roller in opposition to the return means and this rotation compensates the tension in the material. This has the effect of adjusting the tension.

If the strip of material is pulled very hard, the pressure roller is also activated.

In the idle position where limit stops (8*e*–25*c*) on the collar and on the transverse face of the pressure roller are not activated they are in contact. Additional rotation of the pressure roller in opposition to the return means moves said limit stops away from each other. Once this force has been exerted, the pressure roller returns to its initial position due to the backspring effect of the spring until the limit stops come into contact.

Figure 6:
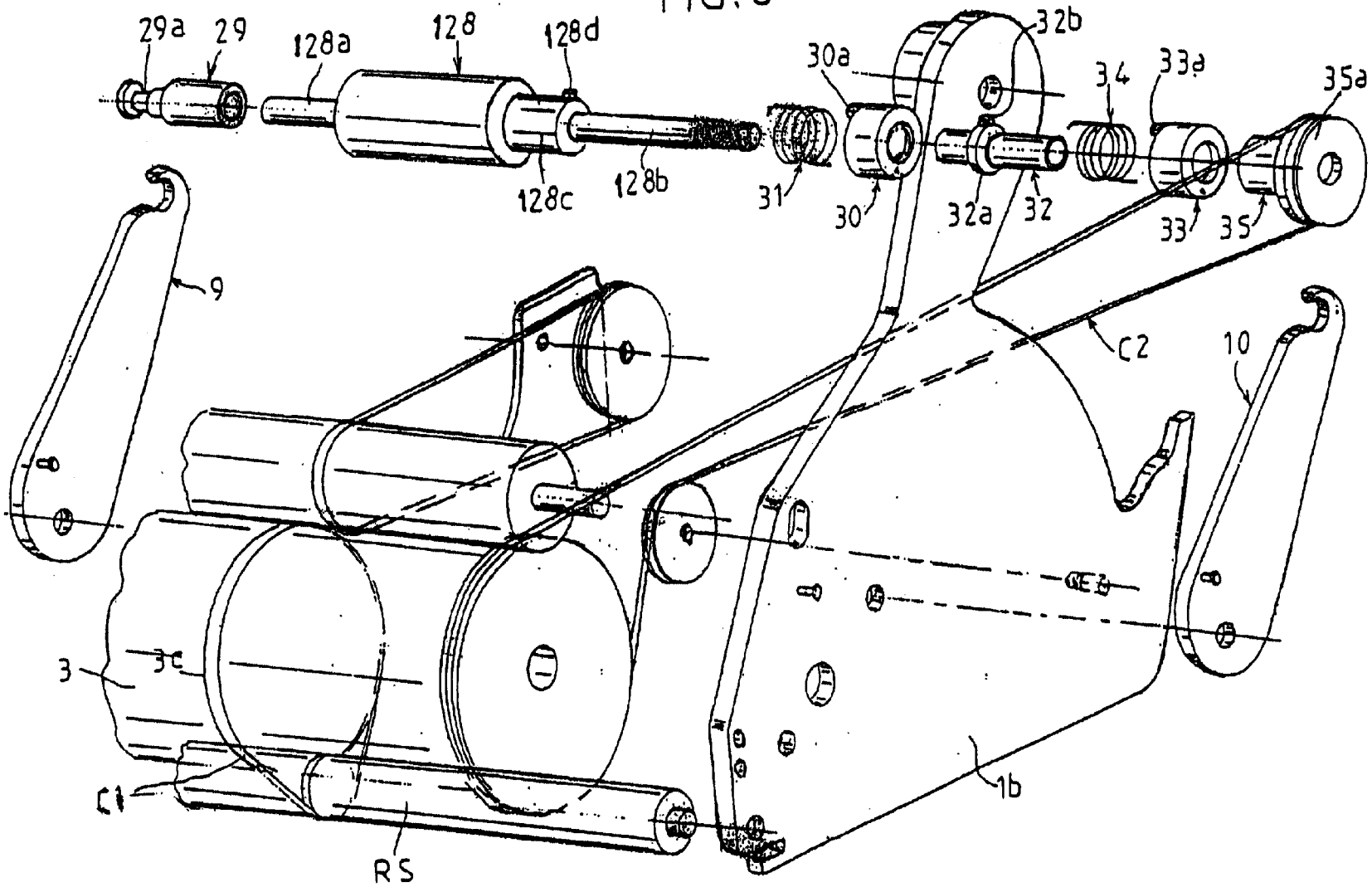
FIG. 6 is a perspective exploded view before assembly showing the tensioning device according to the invention which has a gearing down effect.
Figure 7:
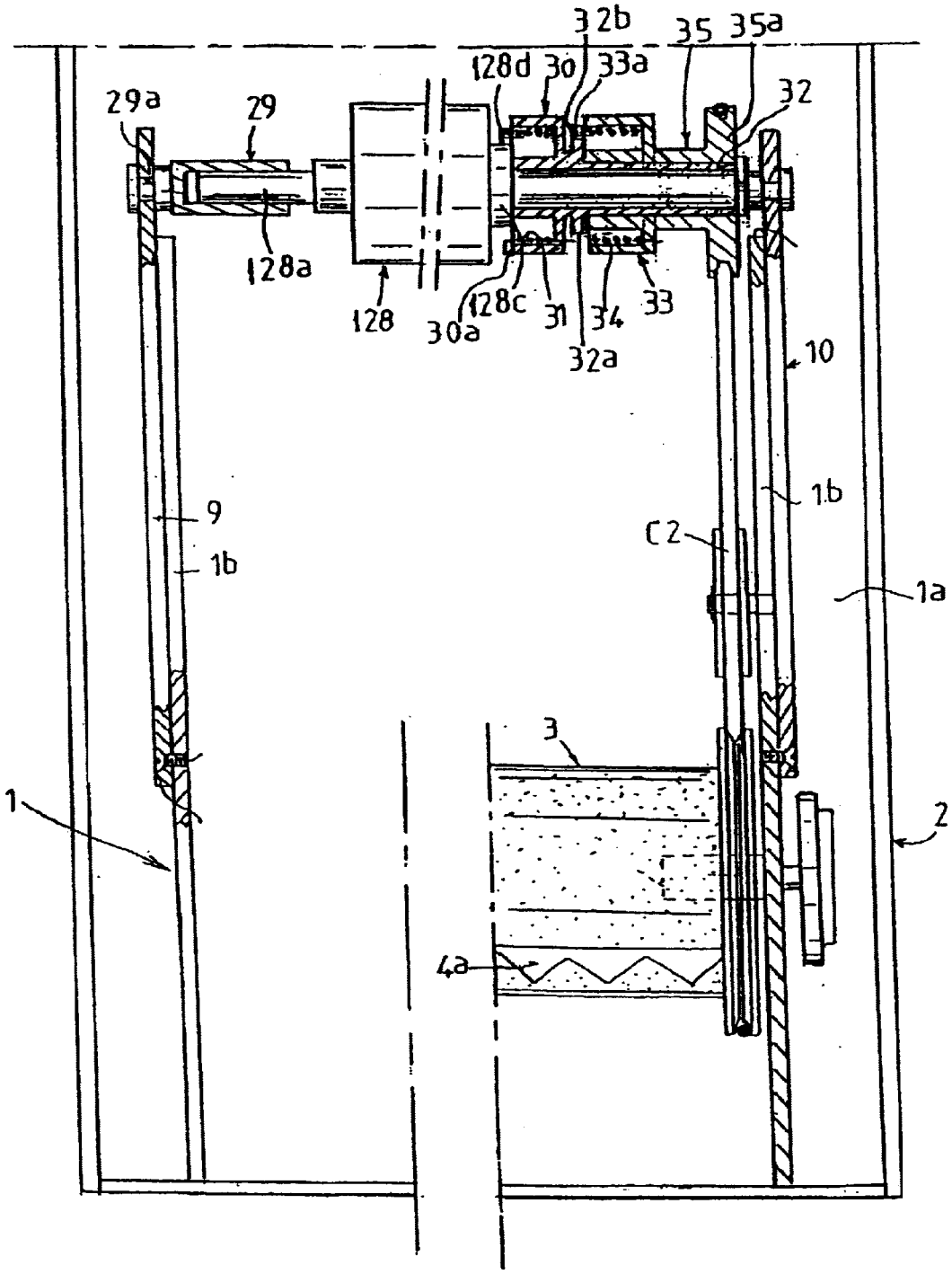
FIG. 7 is a partial cutaway side view of the front of the dispensing machine showing, in particular, how the tensioning device according to FIG. 6 is fitted.

According to another feature relating to the above-mentioned tensioning mechanism, said mechanism is designed to produce a gearing down effect. This specific implementation is illustrated in FIGS. 6 and 7. More specifically, said pressure roller (128) is designed with a long shouldered bearing surface at one end (128*a*) which can accommodate a ring (29) forming a sleeve, the end (29*a*) of which fits into a hook shape of swivelling lever (9) of the pressure roller.

In this specific embodiment, the other end of the pressure roller has a long shouldered bearing surface (128*b*) capable of accommodating the tensioning gearing-down mechanism. More particularly, the long bearing surface accommodates a first internally cut out ring (30) or end piece forming a receptacle to accommodate a return spring (31). This ring has a protruding bearing surface (30*a*) on one of its lateral faces opposite the area where the material rests against the pressure roller. This protruding bearing surface is capable of following the peripheral contour of a collar (128*c*) on the fixed part of the bearing surface of the pressure roller. There is a protruding point or fixed limit stop (128*d*) on said collar which also makes it possible to attach one end of return spring (31).

The other end of said return spring of the first ring is connected to the above-mentioned long fixed bearing surface. Adjacent to the position of said first ring there is a bush (32) with a collar (32*a*) which passes through the first ring and against which a second ring (33) comes into contact, this ring being capable of being rotated in opposition to a second elastic return means (34). This second ring or end piece is located at the end of a support sleeve (35) which in turn has, in opposition, a pulley (35*a*) which accommodates transmission belt (C2) associated with the drum of the dispensing machine. This second ring has a protruding limit stop (33*a*) and is moved when the drum rotates in opposition to its elastic return means, one end of which is attached to the bottom of the ring and the other end of which is attached to a fixed protruding point (32*b*) on the collar (32*a*) of bush (32).

This secondary protruding point (32*b*) is ideally angularly offset relative to fixed protruding point (128*d*) of the first collar. This angular difference is advantageously a few degrees (from 5° to 10° for example). It can vary depending on the required amplitude of the tensioning mechanism.

Said secondary protruding point is physically joined to the support of the first ring to then allow this ring to be driven under the conditions described below.

Operation is as follows:

When the dispensing machine is loaded with a reel of material, the user pulling on the strip of material causes rotation of drum (3), ejection of cutting blade (4*a*) in order to cut a piece off the strip. Said rotation of the drum in turn causes rotation of pressure roller (8) thanks to transmission belt (C2) which links the drum and the pressure roller.

During normal pulling of the strip, the two rings (30–33) of the material tensioning mechanism are not actuated. In contrast, assuming the strip is pulled with greater or lesser or even excessive force, the second ring (33) connected to pulley (35*a*) is rotated relative to the support shaft of the pressure roller. This rotation of the secondary ring takes place in opposition to associated return means (34). The amplitude of this rotation is limited to an angle of the order of 350° until the protruding part (33*a*) of the ring has moved round almost all the opposite-facing fixed collar and then comes up against the support and drive limit stop of the support of the first tensioning ring (30). In turn, the latter is rotated over a maximum angle of roughly 350° until it comes up against and is in contact with the protruding part (128*d*) of the first fixed collar. In this situation, there is successive tensioning of the two return means—in opposition to the tensile force exerted by the user. Once this force has been cancelled out, the return springs successively relax, thereby causing return movement of the two rings in the opposite direction, thus transporting any strip of material which may be inside the machine and thereby eliminating any looping which may have occurred. Return of these rings is ensured until they move as far as they can go and come up against the fixed protruding points on the collars.

This produces a gradual gearing-down effect which is suitable for all circumstances and tensile forces exerted on the strip of paper or other materials. This gearing-down mechanism may include two rings in the above-mentioned example but, if necessary and depending on the nature of the dispensed material, the pressure roller may be designed with one or more additional rings.

Additionally, the front part of the machine comprises a fixed front flap (27) which snaps into the lower part of end shields (1*b*) of the housing in appropriate openings (1*b*6).

A protective plate (28) is also located between the front part of end shields (1*b*) of the machine through an appropriate opening (1*b*7). This protective plate extends towards the rear of the machine in order to separate the area in which the drum and the second pulley are accommodated from the area in which the reel of material and the pressure roller are accommodated.

This plate (28) has protrusions (28*a*) on its rear edge (28*b*) which snap into openings either side of support (23) of the fourth pulley (22). The plate also has, on its forward longitudinal edge (28*c*) protruding fingers (28*d*) which penetrate into openings (1*b*8) between the end shields.

This protective plate (28) has a cut out (28*e*) leaving room for the third transmission belt.

The drum is designed, in a known manner, with a retractable toothed cutting device such as that described in the Applicant's previous patents, particularly in Patent FR 2332215.

The dispensing machine thus described in accordance with the invention has numerous advantages.

In order to solve the first problem stated, it allows a very substantial increase in the tensioned length of the strip of material.

Due to the new positioning of the pressure roller and modification of the latter's functionality with, according to the invention, constant contact between the pressure roller and the load reel, the overall size of the machine is now more compact.

Another advantage is the improved guiding and retention of the strip of material on the drum towards the cutting area. The strip of material is actually held in position by the lower side (20*b*) of the third belt over a considerable angular distance during rotation of the drum before the cutting blade is ejected. There is therefore no possibility of the strip of material slipping.

As stated above, the idler roller may be located with an adjustable clearance relative to the drum in order to take into account the special features of this drum. The drum's diameter may vary depending on its ability to act as a size selector. The drum may be a plain drum, i.e. have no size selection function, but have a different diameter.

The important advantage of the absence of any linkage of the two levers which support the ends of the pressure roller is also emphasised. Swivelling of the levers relative to each other may be differentiated and this is advantageous firstly when fitting the load reel and secondly in order to adapt to any shape of said reel and any deformation thereof.

In addition, said pressure roller can incidentally provide another advantage when fitting a new reel of material. Given the weight of the latter, the pressure roller, due to its elastic mounting and the fact that it swivels towards the rear of the machine, can act as a counterweight in order to assist the operator when installing a new reel.

The material dispensing machine described is versatile and silent in operation. It is of simple construction. It also makes it possible to cut wipe material of any kind.

The features of the machine used for a hand-wipe application have been described, stating the positioning of the mechanisms in a front, parallel arrangement relative to the back of the housing.

Without extending beyond the scope of the invention, the dispensing machine may also be used for toilet paper dispensing applications. In this case, the various mechanisms are oriented at right angles to the back of the housing. Two end shields identical to those described (1*b*) are arranged parallel to the back of the housing. An additional fixing wall is simply added in order to position the support (23) of the fourth pulley which accommodates the third transmission belt.

In addition, the drum may have any shape because there is no longer any pressure or contact with the load reel or with the pressure roller against the drum.

Because of its contact with the protruding flats of the end shields, fitting the cover tends to ensure perfect retention of the mechanisms and components of the machine. Removing or opening the cover enables the operator to grasp the protruding flats and spread apart the resilient end shields (1*b*) so that a new reel of material can be loaded.

The machine described has numerous advantages compared with the prior art. It is particularly silent in operation.

What is claimed is:

1. A dispensing machine for wipe material comprising a housing, a cover, a drum, a cutting blade built into the drum, means of starting and returning the drum including a earn and a start and return spring both located on one side of the drum, lateral end shields of the housing being devised to support the reel of material, a pressure roller being capable of pushing against the strip of material at a specific point in addition to a second pressure area towards the area where the strip of material is cut at the level of the drum, the pressure roller being mounted so that it is articulated and pivoted by first ends of two swivelling levers so that it comes into permanent contact and presses against the reel of material, thereby defining a distance between the tensioning areas defined by reel/pressure roller contact on the one hand and drum/cutting blade ejection on the other hand of the order of 25 to 50 cm, characterised in that second ends of said two levers are pivotally attached to the lateral end shields wherein the two levers pivot independently so that the pressure roller can swivel with variations of each of said levers to match the profile of the reel of material.

2. The dispensing machine as claimed in claim 1 characterised in that the pressure roller and the drum are linked by a transmission belt.

3. The dispensing machine as claimed in claim 1 characterised in that the rear edges of the end shields of the housing of the machine are designed with a curved shape forming a guide ramp, thus enabling backward displacement of the pressure roller which is designed so that its ends move along said edge and in that the upper pads of the levers are designed to form hook shaped parts which accommodate the ends of the pressure roller and the lower parts of which are articulated on each of end shields, each lever being associated with a return spring one end of which is attached to said end shield.

4. The dispensing machine as claimed in claim 2 characterised in that the pressure roller comprises a first return pulley located on the inside of the machine relative to the end shields facing the housing, said first pulley accommodating a second belt mounted so that it protrudes from a second pulley located on the shaft of the drum and in that there is a third freely rotatable pulley at the rear of the machine, said third pulley fulfilling the function of keeping the second belt evenly tensioned.

5. The dispensing machine as claimed in claim 1 characterised in that it comprises a idler roller rotatably mounted at the front of the machine located in openings in the end shields of the housing and in that the idler roller does not touch the drum and is used to deflect the strip of material towards the drum and its cutting device and in that said idler roller has a central groove leaving room for a third transmission halt which is held at the rear of the machine by a fourth pulley located beyond drum, said fourth pulley being located in the axial plane of said groove and of a central groove in the drum.

6. The dispensing machine as claimed in claim 5 characterised in that the upper side of the belt links the idler roller and the fourth pulley without touching the drum whereas the lower side of the belt is firmly in contact with the drum over an angular distance in the area of the central groove, and in that the strip of material from the reel is inserted, after the idler roller, in the gap formed by the drum and said side of the belt with a view to guiding it towards the cutting device during rotation of the drum, said side fulfilling the function of temporarily holding the material against the drum.

7. The dispensing machine as claimed in claim 5 characterised in that a support of the fourth pulley has a curved edge facing the drum and concentric with the periphery of said drum, thus accompanying the strip of material towards the outlet of the machine.

8. The dispensing machine as claimed in claim 5 characterised in that the ends or the idler roller are fixed to the end shields in openings, the clearance of said idler roller with respect to the drum being adjustable depending on its position in said openings.

9. The dispensing machine as claimed in claim 1 characterised in that one end of the pressure roller cooperates with a mechanism for tensioning the strip of material, said mechanism being mounted on one of the swivelling levers.

10. The dispensing machine as claimed in claim 9 characterised in that the one end of the pressure roller comprises a cylindrical cavity allowing partial engagement of an end piece which rests on the one of the swivelling levers, said pressure roller accommodating a first pulley used to guide a second transmission belt, said pressure roller having a collar comprising a limit stop, said pressure roller extending into the cylindrical cavity as a cylindrical bearing surface in which is disposed an elastic return means, said elastic means being attached firstly to the collar and secondly in a bottom of the cavity.

11. The dispensing machine as claimed in claim 10 characterised in that the cylindrical bearing surface of the pressure roller has a protruding shape defining a limit stop and cooperating, when the pressure roller rotates, with a limit stop of the end piece to limit the tensioning at the pressure roller in opposition to the elastic return means.

12. The dispensing machine as claimed in claim 9 characterised in that the mechanism for tensioning comprises a gearing-down mechanism.

13. The dispensing machine as claimed in claim 12 characterised in that the pressure roller comprises a shouldered bearing surface on one side accommodating at least two rings that are successively actuated in opposition to an elastic return means when the strip of material if pulled, one of the rings causing rotation of the other ring after rotational travel and providing a gearing-down effect and tensioning the material to be cut, the pressure roller fulfilling the function of tensioning the material to be cut.

14. The dispensing machine as claimed in claim 13 characterised in that the pressure roller comprises a long shouldered bearing surface which accommodates the gearing-down mechanism, the long bearing surface accommodating a first internally cut out ring forming receptacle to accommodate a return spring, said ring having a protruding bearing surface on one of its lateral faces opposite an area where the material rests against the pressure roller, capable of following a peripheral contour of a collar on a fixed part of the long bearing surface of the pressure roller, a fixed limit stop being located on said collar to attached one end of said return spring, and in that the other end of said return spring of the first ring is connected to the long bearing surface.

15. The dispensing machine as claimed in claim 14 characterised in that, adjacent to a position of said first ring, there is a bush having a collar which passes through the first ring and against which a second ring comes into contact, the second ring being capable of being rotated in opposition to a second elastic return means, the second ring being located at an end of a support sleeve which in turn has, in opposition, a pulley which accommodates a transmission belt associated with the drum of the dispensing machine, and in that the second ring comprises a protruding limit stop and is moved when the drum rotates in opposition to the elastic return means, one end of which is attached to a bottom of the second ring and the other end of which is attached to a fixed protruding point on the collar of the bush, said second ring causing rotation of said first ring.

16. The dispensing machine as claimed in claim 14 characterised in that a fixed protruding point is angularly offset relative to the fixed limit stop of the first collar.

17. The dispensing machine as claimed in claim 16 characterised in that fixed protruding point is physically joined to a support of the first ring to then allow the first ring to be driven.

18. The dispensing machine as claimed in claim 1 characterised in that the second end of the pressure roller has a bearing surface allowing it to fit in a telescopic shaft, one end of the telescopic shaft fits on the swivelling lever.

19. The dispensing machine as claimed in claim 1 characterised in that it comprises, in a front part, a fixed front flap separately mounted on the lower part of the end shields of the housing in openings.

20. The dispensing machine as claimed in claim 1 characterised in that it comprises a protective plate located between the front part of the end shields of the machine, this plate extending towards the rear and being fixed in openings on the back surface of the housing.

21. The dispensing machine as claimed in claim 1 characterised in that the end shields are externally designed with a gripping flat enabling the operator to spread apart the resilient end shields and in that the gripping flats are pressed against the inside surface of the walls of the housing when the latter is fitted, thereby ensuring retention of the mechanisms and components of the machine.

22. The dispensing machine as claimed in claim 1 in applications for dispensing paper hand wipes.

23. The dispensing machine as claimed in claim 1 in applications for dispensing toilet paper.

* * * * *

UNITED STATES PATENT AND TRADEMARK OFFICE

CERTIFICATE OF CORRECTION

PATENT NO. : 6,691,597 B2
DATED : February 17, 2004
INVENTOR(S) : Granger

It is certified that error appears in the above-identified patent and that said Letters Patent is hereby corrected as shown below:

Column 9,
Line 27, delete the word “halt” and insert -- belt --

Column 10,
Line 2, delete the word “a” and insert -- the --
Line 3, delete the words “end piece” and insert -- collar --.
Line 21, insert the word -- shouldered -- after the word “long”
Line 22, insert the word -- a -- after the word “forming”
Line 50, delete the word “first”

Signed and Sealed this

First Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,691,597 B2
DATED : February 17, 2004
INVENTOR(S) : Granger

It is certified that error appears in the above-identified patent and that said Letters Patent is hereby corrected as shown below:

Column 9,
Line 27, delete the word “halt” and insert -- belt --

Column 10,
Line 2, delete the word “a” and insert -- the --
Line 3, delete the words “end piece” and insert -- collar --.
Line 3, delete the word “at” and insert -- of --
Line 21, insert the word -- shouldered -- after the word “long”
Line 22, insert the word -- a -- after the word “forming”
Line 27, insert the word -- shouldered -- after the word “long”
Line 28, delete the word “attached” and insert -- attach --
Line 30, insert the word -- internally cut off -- after the word “said”
Line 43, insert the word -- second -- before the word “elastic”
Line 50, delete the word “first”

This certificate supersedes Certificate of Correction issued June 1, 2004.

Signed and Sealed this

Twenty-first Day of September, 2004

JON W. DUDAS
*Director of the United States Patent and Trademark Office*

UNITED STATES PATENT AND TRADEMARK OFFICE

CERTIFICATE OF CORRECTION

PATENT NO. : 6,691,597 B2
DATED : February 17, 2004
INVENTOR(S) : Granger

It is certified that error appears in the above-identified patent and that said Letters Patent is hereby corrected as shown below:

Column 9,
Line 27, delete the word "halt" and insert -- belt --

Column 10,
Line 2, delete the word "a" and insert -- the --
Line 3, delete the words "end piece" and insert -- collar --.
Line 3, delete the word "at" and insert -- of --
Line 21, insert the word -- shouldered -- after the word "long"
Line 22, insert the word -- a -- after the word "forming"
Line 27, insert the word -- shouldered -- after the word "long"
Line 28, delete the word "attached" and insert -- attach --
Line 30, insert the word -- shouldered -- after the word "long"
Line 33, insert the word -- internally cut off -- after the word "said"
Line 43, insert the word -- second -- before the word "elastic"
Line 50, delete the word "first"

This certificate supersedes Certificate of Correction issued June 1, 2004 and September 21, 2004.

Signed and Sealed this

Thirtieth Day of November, 2004

JON W. DUDAS
*Director of the United States Patent and Trademark Office*